US007762335B2

(12) United States Patent
Anderson et al.

(10) Patent No.: US 7,762,335 B2
(45) Date of Patent: Jul. 27, 2010

(54) SWITCHING APPARATUS BETWEEN INDEPENDENT CONTROL SYSTEMS FOR A SUBSURFACE SAFETY VALVE

(75) Inventors: David Z. Anderson, Glenpool, OK (US); Darren E. Bane, Broken Arrow, OK (US); Alan N. Wagner, Broken Arrow, OK (US); John E. Gunnells, Broken Arrow, OK (US); Anthony S. Coghill, Tulsa, OK (US); Allen P. Carney, Tulsa, OK (US); Barry Lee Brown, Tulsa, OK (US); Troy L. Smith, Tulsa, OK (US); Jeremy R. Johnson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 440 days.

(21) Appl. No.: 11/843,931

(22) Filed: Aug. 23, 2007

(65) Prior Publication Data

US 2009/0050327 A1 Feb. 26, 2009

(51) Int. Cl.
*E21B 34/10* (2006.01)

(52) U.S. Cl. ..... 166/321; 166/332.1; 166/334.1; 166/375

(58) Field of Classification Search ..... 166/321, 166/332.1, 334.1, 332.8, 375
See application file for complete search history.

(56) References Cited

U.S. PATENT DOCUMENTS 4,838,355 A * 6/1989 Leismer et al. ..... 166/375
4,951,753 A * 8/1990 Eriksen ..... 166/375
6,109,351 A 8/2000 Beall
6,158,714 A 12/2000 Lembcke et al.
6,877,564 B2 4/2005 Layton et al.
6,902,006 B2 6/2005 Myerley et al.

FOREIGN PATENT DOCUMENTS

WO 2006069247 6/2006

OTHER PUBLICATIONS

Arrazola, A., et al., "Design Methodologies for Upper Completion Deepwater Subsea and Dry Tree Applications", SPE 123034, May 2009, 1-15.
Hahn, D.E., et al., "Importance of Completion Design Considerations for Complex, Hostile, and HPHT Wells in Frontier Areas" SPE 59750, Apr. 2000, 1-11.
Aldridge, Don, et al., "Meeting the Challenges of Deepwater Subsea Completion Design", SPE 36991, Oct. 1996, 1-5.

* cited by examiner

*Primary Examiner*—Giovanna C Wright
(74) *Attorney, Agent, or Firm*—Steve Rosenblatt

(57) ABSTRACT

A system is provided for switching between redundant control systems for a subsurface safety valve (SSV) while being able to isolate the closure spring from hydrostatic pressure in the control line of the system that is not being used. There are two control lines that connect to discrete operating pistons that are both coupled to the flow tube. Each operating piston is connected to a control rod with the control rods terminating near opposed ends of a pivoting member. Pushing down on one rod pushes up on the other rod so that the other rod is held supported and the hydrostatic pressure in its associated control line doesn't affect the force needed by the closure spring to close the SSV. Releasing control line pressure puts the system in neutral to allow either of the systems to be reselected.

22 Claims, 3 Drawing Sheets

SWITCHING APPARATUS BETWEEN INDEPENDENT CONTROL SYSTEMS FOR A SUBSURFACE SAFETY VALVE

FIELD OF THE INVENTION

The field of the invention is control systems for subsurface safety valves (SSV) and more particularly a device that allows changeover to a redundant system while isolating a closure spring from the hydrostatic pressure effects of one of the control lines from the surface to the SSV.

BACKGROUND OF THE INVENTION

SSVs are used in production strings to control the well. They are mounted in the string and are hydraulically controlled from the surface. Typically a control line runs parallel to the production string and is connected to the SSV housing. Applying pressure moves a piston that is connected to a flow tube. The flow tube is pushed against a closure spring by the piston. The flow tube also engages a flapper to rotate it 90 degrees so that the flow tube can advance as the open flapper is now outside the flow tube. The housing has a seat and the flapper is biased by a torsion spring against the seat. The movement of the piston to urge the flow tube to move winds the torsion spring and compresses the closure spring at the same time. When pressure is removed or lost from the control line, the closure spring pushes the flow tube and interconnected operating piston against the hydrostatic pressure in the control line so that as the flow tube rises the torsion spring is enabled to rotate the flapper into contact with the seat.

If a problem occurs within the SSV it usually means that it has to be pulled with the production string. Variations involving balance control lines or pressurized chambers in the SSV housing have been developed to allow offsetting of hydrostatic pressure since the hydrostatic pressure in the main control line is offset and that allows a smaller closure spring to close the valve without having to also overcome the hydrostatic pressure in the control line.

Problems could occur in the hydraulic actuation system such as a control line leak or an operating piston seal leak, for example. Dual operating control systems have been developed so that one operates the SSV while the other system is isolated until needed. In these systems, each control system had its own control line and operating piston where both operating pistons were engaged to the flow tube. In order not to burden the single closure spring with the added hydrostatic pressure from two parallel control lines the system that is offline is isolated with a rupture disc so that the hydrostatic pressure above the disc is not felt by the closure spring until the disc is broken, generally by raising tubing pressure.

However, in subsea systems the delivered pressures are controlled and can't be arbitrarily raised to affect a switch to the backup control system by raising the pressure in the system above the normal operating range. This condition in subsea systems has been addressed by the present invention. There are the two control lines each going to a discrete independent operating piston. Each piston is coupled to a rod and the two rods interact. The rod associated with the piston where control line pressure is applied is free to move to operate the SSV in the normal manner. The movement of the first piston and its associated rod results in support for the other rod in a variety of ways explained below. The result is that the rod associated with the non-pressurized system has the hydrostatic pressure in its control line isolated from the closure spring. Removing applied pressure from the control lines lets the system go back to neutral so that either of the two redundant systems can be thereafter activated. Those skilled in the art will gain a better understanding of the invention from the description of the preferred embodiment with the associated drawings that appear below with the understanding that the claims define the full scope of the invention.

SUMMARY OF THE INVENTION

A system is provided for switching between redundant control systems for a subsurface safety valve (SSV) while being able to isolate the closure spring from hydrostatic pressure in the control line of the system that is not being used. There are two control lines that connect to discrete operating pistons that are both coupled to the flow tube. Each operating piston is connected to a control rod with the control rods terminating near opposed ends of a pivoting member. Pushing down on one rod pushes up on the other rod so that the other rod is held supported and the hydrostatic pressure in its associated control line doesn't materially affect the force needed by the closure spring to close the SSV. Releasing control line pressure puts the system in neutral to allow either of the systems to be reselected.

DETAILED DESCRIPTION OF THE PREFERRED EMBODIMENT

For clarity, most of the common components of SSVs are omitted from the FIGS. Instead the focus is on showing the flow tube and operating pistons that are attached to it. Those skilled in the art will know that a closure spring is below the flow tube and is compressed when the flow tube is forced down by the operating piston. In turn, pressure in a control line is delivered to an operating piston that can be of an annular or rod shape and is sealed in a bore in the SSV housing. Of course, the flow tube rotates the flapper when moved down and the torsion spring on the flapper pivot rotates the flapper to its seat when the closure spring pushes up the flow tube.

With all that as an introduction to typical components in a SSV, the drawings will show how those systems interact when redundant systems are provided and there is a need to be able to switch between them as well as to isolate hydrostatic pressure from the control line associated with the system that is not in use.

Figure 1:
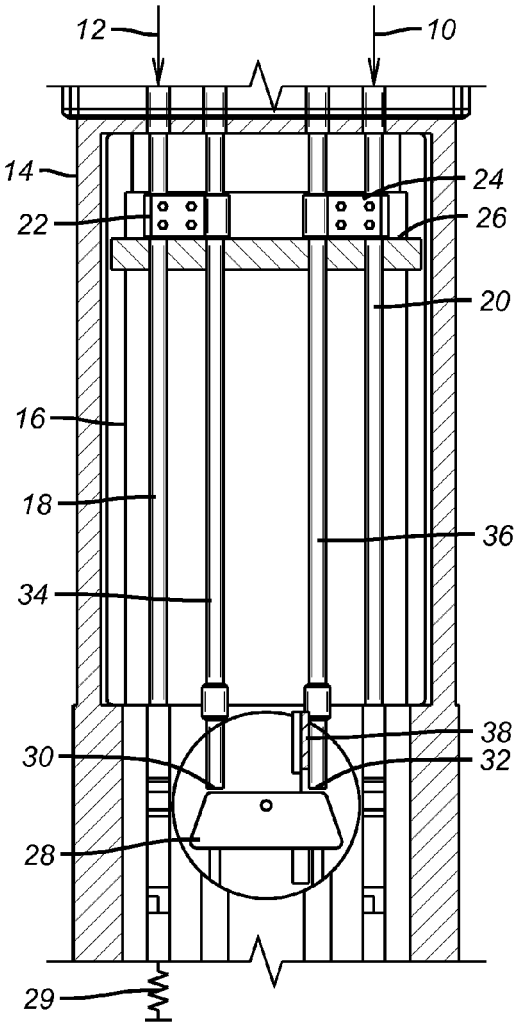
FIG. 1 is a section view of one embodiment of the system in a neutral position.
Figure 2:
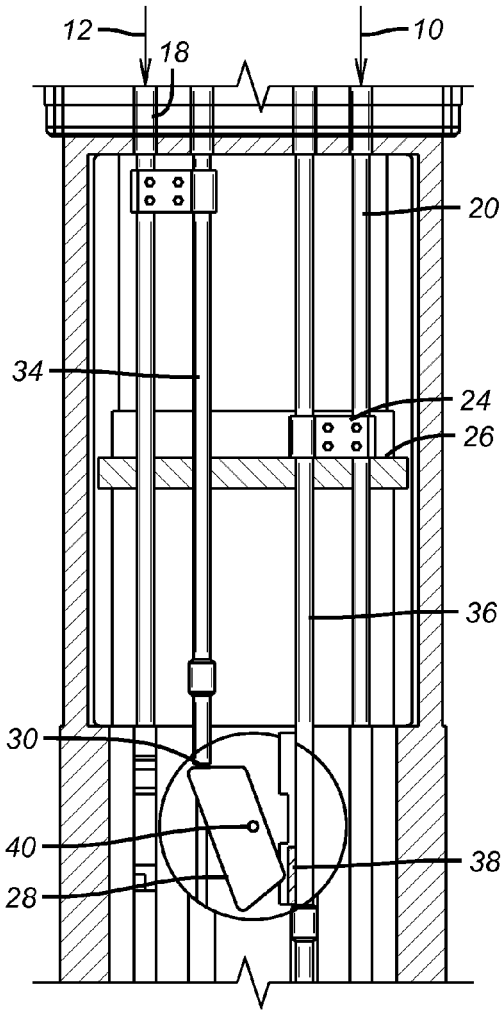
FIG. 2 is the view of FIG. 1 with one system activated and the other having its hydrostatic pressure isolated.

FIGS. 1 and 2 are illustrative of one embodiment. Arrows 10 and 12 schematically illustrate control lines from the surface to a SSV housing 14. The housing 14 is shown cut away so that the flow tube 16 within can be seen. Line 12 leads to operating piston 18 and line 10 leads to operating piston 20. As is well known in the art the operating pistons 18 and 20 have seals in a bore in the housing 14 so that applied pressure in their respective control lines 12 and 10 results in movement of the respective piston. Piston 18 has a clamp or similar device 22 attached to it while piston 20 has a similar device 24. Devices 22 and 24 are designed to move in tandem with their respective piston. Flow tube 16 has a radial surface 26 that is designed to be engaged by clamps 22 or 24 when either one is moved from the FIG. 1 position by pressure applied in control lines 10 or 12. As is well known in the art, the flow tube 16 has its downward motion resisted by a closure spring. Additionally, downward movement of the flow tube 16 rotates a flapper 90 degrees and away from its seat and behind the flow tube 16 to define the valve open position. The closure spring acting on the flow tube 16 returns it to the valve closed position shown in FIG. 1.

Mounted within the housing 14 is a pivoting member 28 on which rests the lower ends 30 and 32 of rods 34 and 36 respectively. Rod 34 is clamped to piston 18 and rod 36 is clamped to piston 20 respectively by clamps 22 and 24 for tandem movement. Shown illustratively on rod 36 but also useful on rod 34 is a wear pad 38 that gives lateral support to the rod 36 when pivoting member 28 is rotated against it, as shown in FIG. 2. As also shown in FIG. 2, the pivoting member 28 is underneath lower end 30 so as to support rod 34. Since rod 34 is attached to piston 18 through clamp 22, the hydrostatic pressure in control line 12 is supported in the FIG. 2 position from pivot pin 40.

FIG. 2 shows control line pressure applied to control line 10 while no external pressure is applied to control line 12. Piston 20 with attached clamp 24 has been pushed down. Clamp 24 has engaged surface 26 so that the flow tube 16 moves in tandem with clamp 24. That very movement brings down rod 36, which causes pivoting member 28 to rotate clockwise about pivot pin 40 until pivoting member 28 is pushing laterally on wear pad 38. At the same time, another portion of pivoting member 28 has gotten under lower end 30 because of the frusto-conical shape of member 28. In the FIG. 2 position, rod 34 and piston 18 clamped to it are fully supported from member 28 so that the hydrostatic pressure from line 12, which at this time has no applied pressure, is transmitted through rod 34 and pivot pin 40 laterally into wear pad 38. When pressure is removed from line 10, the closure spring that acts on the flow tube 16 pushes it up to allow the components to return from the FIG. 2 position back to the FIG. 1 position. Subsequently, applying pressure to line 12 simply makes the member 28 rotate counterclockwise as clamp 22 lands on shoulder 26 to push the flow tube 16 down to open the SSV.

What is illustrated in FIGS. 1 and 2 is a SSV with a redundant control system where the control system that is off line has its hydrostatic pressure in its respective control line isolated from having any force applied to the flow tube 16 so that the closure spring shown schematically as 29 can be sized for the hydrostatic pressure from a single control line when there are redundant control systems in place, particularly in a situation where pressures higher than the normal operating pressures to open the SSV cannot be applied, such as in subsea systems. It should be noted that unlike a backup system that is isolated with a rupture disc, this system continues to isolate hydrostatic pressure from the control line of a dual system that is not in active use regardless of how many times cycling has gone on between the redundant systems. In a system where the redundant system is isolated with a rupture disc, once the disc is broken, the hydrostatic pressure in the associated control line will no longer be isolated.

Figure 3:
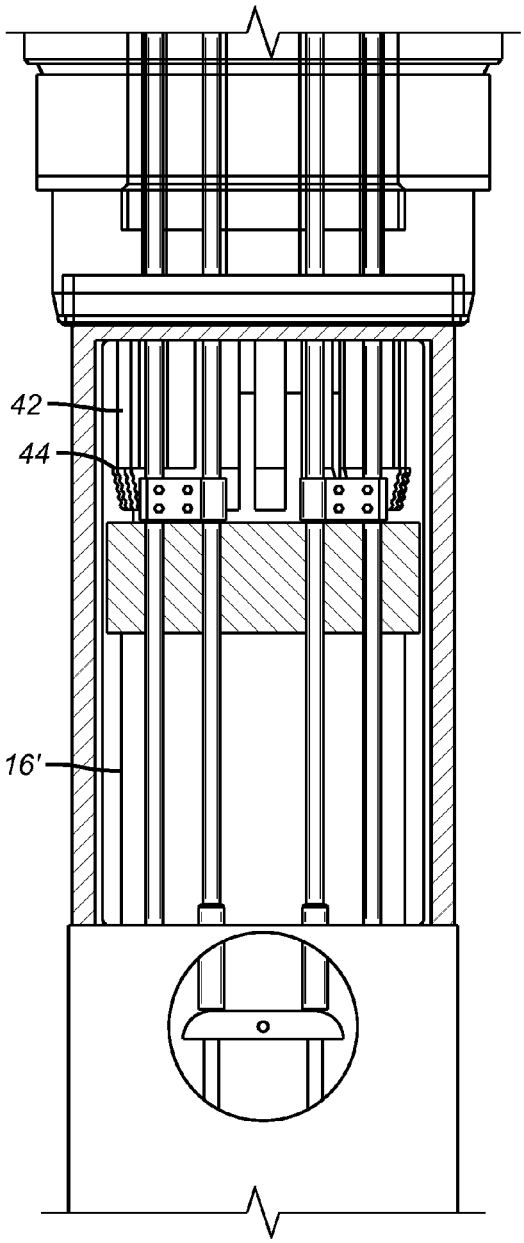
FIG. 3 is an alternative embodiment in the neutral position.
Figure 4:
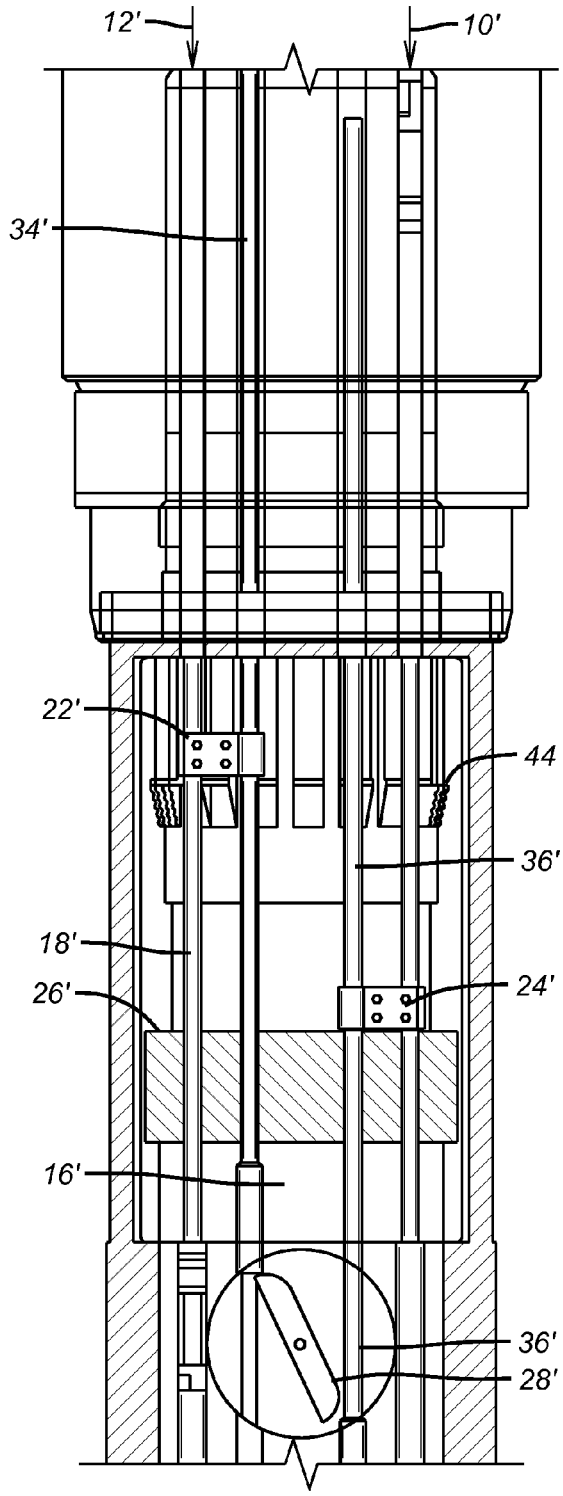
FIG. 4 is the view of FIG. 3 with one system actuated and the other having its hydrostatic pressure isolated.
Figure 5:
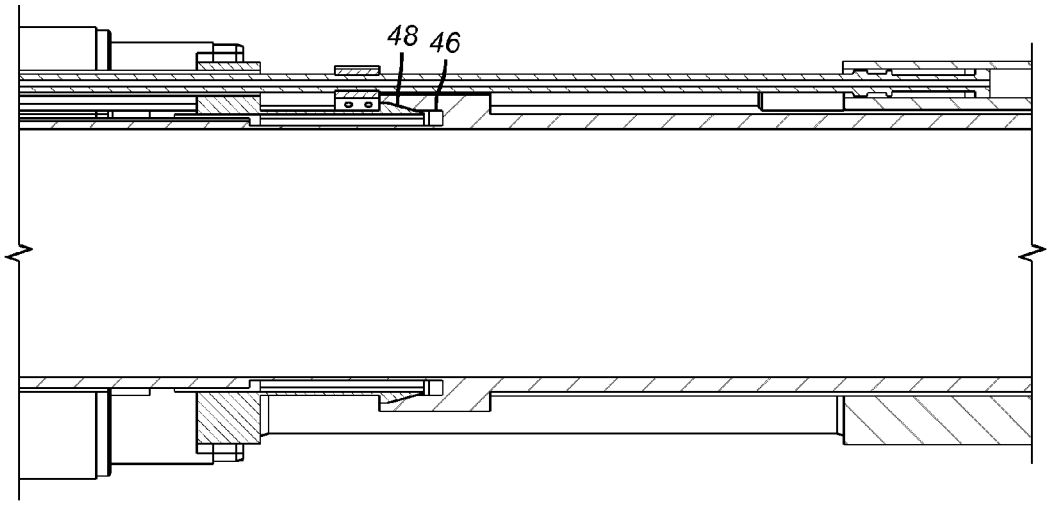
FIG. 5 shows how the isolated system is released from isolation.
Figure 6:
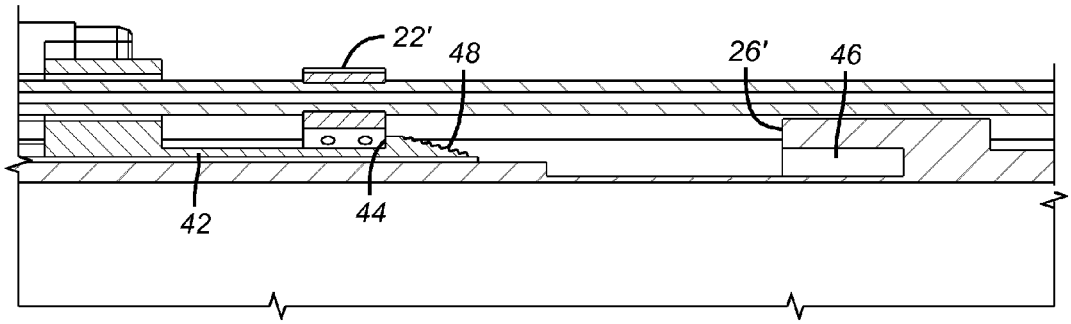
FIG. 6 shows how the isolated system is held in isolation.
Figure 7:
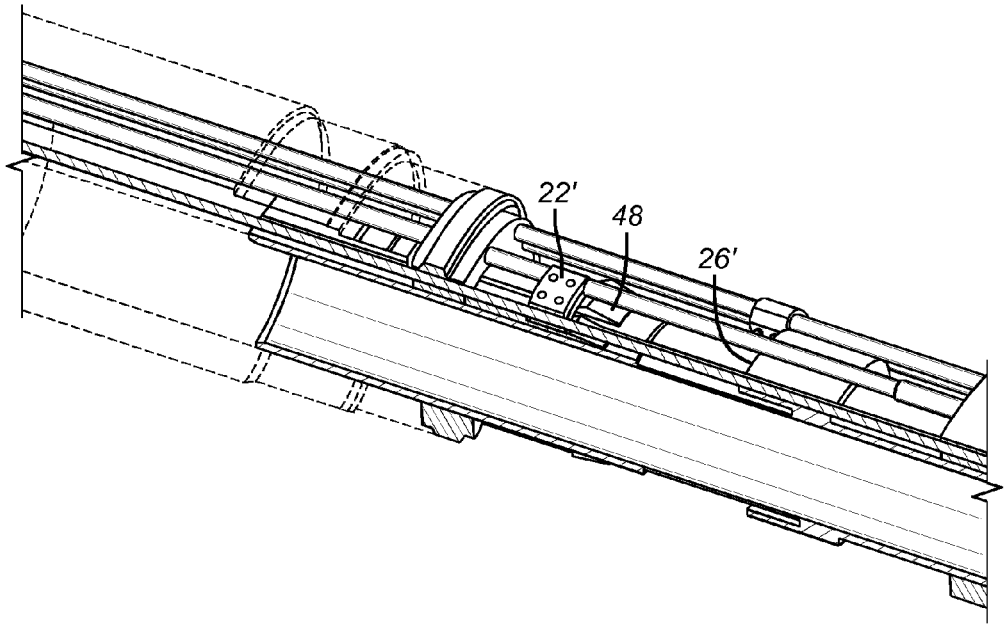
FIG. 7 is a perspective view of FIG. 6.

FIG. 3 shows a preferred embodiment that is similar in operation to FIGS. 1 and 2 except in the manner the hydrostatic pressure in the off line system is isolated from the flow tube 16'. Instead of transmitting the hydrostatic force through pivoting member 28 and its pin 40 into a lateral load on a wear pad such as 38 on the rod that has been pushed down by the control system that has had pressure applied to it, the preferred system of FIG. 3 employs a series of collets 42 that have a support surface 44. Collets 42 are sprung radially outwardly but do not move longitudinally. As shown in FIG. 4 the collar 22' gets pushed up in the manner previously described until it goes higher than support surface 44. From that point piston 18' is supported and the hydrostatic pressure in line 12' is effectively isolated from flow tube 16' and from the closure spring that eventually has to push it up when applied pressure is removed from control line 10'. Clamp 22' resists all the hydrostatic, when landed on support surface 44, so that little if any lateral force is transmitted through pivoting member 28' to rod 36' after clockwise rotation of member 28'. Just as before for moving down the flow tube 16' there is a shoulder 26' for either clamp 22' or 24' to engage to push down the flow tube 16'. The difference is how a clamp such as 22' once resting on support surface 44 is enabled to move down beyond it. This can better be understood by looking at the section views of FIGS. 5 and 6. In FIG. 6, clamp 22' is shown supported from surface 44 of collets 42. Shoulder 26' is also illustrated in the pushed down position that has resulted from clamp 24' pushing it down. When applied pressure in control line 10' is removed the closure spring abutting flow tube 16' will push it up relative to surface 44 that is stationary but sprung radially outwardly. As the flow tube 16' comes up with rod 36' shoulder 26' is also moving up and bringing circumferential channel 46 close to the ends 48 of collets 42. The conclusion of this movement is shown in FIG. 5 where the ends 48 have been pulled inwardly by landing in channel 46. As soon as that happens, the hydrostatic pressure in line 12' can push down rod 34' and the pivoting member 28' rotates counterclockwise from the FIG. 4 position back to the FIG. 3 position. FIG. 7 is simply a perspective view of FIG. 6.

While motion of the components in one direction and a return to the neutral position has been described, those skilled in the art will appreciate that with a redundant system available, either one can be actuated first and the difference is simply the pivot direction of member 28 or 28'. Thus, the advantage of isolating hydrostatic pressure from one of the surface control lines from the flow tube is simply accomplished in either embodiment particularly in a situation where the hydraulic system is regulated not to exceed the normal range of operating pressures. Additionally, the illustrated systems offer an advantage over rupture disc isolation in that they are cycle independent as compared to a rupture disc system which works once and is disabled. Further, the use of a rupture disc for an isolator carries additional risks of fragments breaking off the disc when it is deliberately broken and causing the piston below to jam or its seals to leak. Either event will normally require pulling a string with the SSV at significant cost. While a variety of solutions to a changeover from one redundant system to another have been illustrated, those skilled in the art will appreciate that the invention encompasses redundant systems that allow for changeover any number of times while isolating the closure spring from hydrostatic of any redundant line(s). While one backup system has been illustrated, more than one backup system can be integrated into a SSV.

While clamped rods have been illustrated in conjunction with pivoting member 28, those skilled in the art will appreciate that such rods can be eliminated for protruding structures directly from a piston. In FIG. 1 for example, clamp 24 can still engage surface 26 but rod 36 can be replaced with a tab coming out of piston 20 and positioned to engage pivoting member 28 to rotate it clockwise. In the same manner, rod 34 can also be replaced.

The above description is illustrative of the preferred embodiment and many modifications may be made by those skilled in the art without departing from the invention whose scope is to be determined from the literal and equivalent scope of the claims below.

We claim:

1. A valve for downhole use, comprising:

a housing having a passage therethrough and a valve member assembly selectively positioned in an open and closed position with respect to said passage;

said valve member assembly actuated by one of a plurality of pistons operatively connected to it wherein each piston is further connected to an associated control line through which hydrostatic pressure is exerted and at least one piston is capable of being selectively supported and unsupported more than one time to only allow hydrostatic pressure from one control line at a time to be communicated to said valve member while being able to switch more than once between two said pistons for operation of said valve member assembly.

2. The valve of claim 1, wherein:

support for one piston against hydrostatic pressure in said control line associated with it comes directly or indirectly from said housing.

3. The valve of claim 2, wherein:

at least a pair of pistons are operatively connected to each other by a pivoting member, said pivoting member converting one piston's movement in a first direction into movement by a second piston in an opposite direction.

4. The valve of claim 3, wherein:

movement by one piston from applied pressure to its respective control line moves said valve member assembly and induces opposite direction movement of the other piston until it is selectively supported by said housing.

5. The valve of claim 4, wherein:

said housing further comprises a movable support surface that flexes to grasp a raised portion of said other piston as said raised portion moves over said support surface.

6. The valve of claim 5, wherein:

said movable support surface is selectively engaged by said valve member assembly to release said raised portion of said other piston from support from said housing.

7. The valve of claim 6, wherein:

said valve member assembly comprising a radial surface selectively engageable by a raised portion of either piston to move it;

said radial surface further comprising a circumferential recess to selectively trap a plurality of collets that define said movable support surface.

8. The valve of claim 7, wherein:

said raised portion on said pistons comprises a clamp that holds a rod that abuts said pivoting member on opposed sides of a pivot support.

9. The valve of claim 8, wherein:

said pivoting member defines a neutral position with both clamps supported by said radial surface;

said pivoting member rotatable clockwise or counterclockwise depending on which of said control lines have pressure applied thereto.

10. The valve of claim 9, wherein:

movement of said clamp being pushed by a piston experiencing applied pressure in said control line moves said valve member assembly from said radial surface and also moves said rod of said clamp being pushed to rotate said pivoting member to move said clamp on said other rod until it gains support on said movable support surface.

11. The valve of claim 1, wherein:

said valve comprises a subsurface safety valve and said valve member assembly comprises a flapper rotated by a flow tube that is operatively driven against a closure spring by each of said pistons wherein said closure spring only has to overcome hydrostatic pressure selectively in the one of said control lines where applied pressure is removed.

12. A valve for downhole use, comprising:

a housing having a passage therethrough and a valve member assembly selectively positioned in an open and closed position with respect to said passage;

said valve member assembly actuated by one of a plurality of pistons operatively connected to it wherein each piston is further connected to an associated control line through which hydrostatic pressure is exerted and each piston is selectively supported to only allow hydrostatic pressure from one control line at a time to be communicated to said valve member;

support for one piston against hydrostatic pressure in said control line associated with it comes directly or indirectly from another said piston.

13. A valve for downhole use, comprising:

a housing having a passage therethrough and a valve member assembly selectively positioned in an open and closed position with respect to said passage;

said valve member assembly actuated by one of a plurality of pistons operatively connected to it wherein each piston is further connected to an associated control line through which hydrostatic pressure is exerted and each piston is selectively supported to only allow hydrostatic pressure from one control line at a time to be communicated to said valve member;

support for one piston against hydrostatic pressure in said control line associated with it comes directly or indirectly from another said piston;

at least a pair of pistons are operatively connected to each other by a pivoting member.

14. The valve of claim 13, wherein:

movement of a first piston causes said pivoting member to rotate into a supporting position for a second piston.

15. The valve of claim 14, wherein:

said first piston supports said pivoting member in said supporting position for the second piston.

16. The valve of claim 15, wherein:

initial movement of a second piston causes said pivoting member to rotate in a reverse direction than when the initial movement is by the first piston putting said second piston into a supporting position for a first piston.

17. The valve of claim 16, wherein:

said second piston supports said pivoting member in said supporting position for the first piston.

18. The valve of claim 17, wherein:

said first and second piston are each connected to a respective rod for tandem movement wherein the rods engage said pivoting member on opposite sides of a pivot that supports said pivoting member.

19. The valve of claim 18, wherein:

said rods are each retained to a respective piston by a clamp:

said valve member having a shoulder positioned for selective engagement by said clamps to operate said valve member assembly.

20. The valve of claim 19, wherein:

said rods further comprise a raised wear surface for selective contact with said pivoting member after a predetermined movement of said rods.

21. The valve of claim 13, wherein:

said pivoting member is rotatable in opposite directions from a neutral position where it supports both pistons.

22. A valve for downhole use, comprising:

a housing having a passage therethrough and a valve member assembly selectively positioned in an open and closed position with respect to said passage;

said valve member assembly actuated by one of a plurality of pistons operatively connected to it wherein each piston is further connected to an associated control line through which hydrostatic pressure is exerted and each piston is selectively supported to only allow hydrostatic pressure from one control line at a time to be communicated to said valve member;

said valve comprises a subsurface safety valve and said valve member assembly comprises a flapper rotated by a flow tube that is operatively driven against a closure spring by each of said pistons wherein said closure spring only has to overcome hydrostatic pressure selectively in the one of said control lines where applied pressure is removed;

cycling of which control line hydrostatic pressure is isolated can occur multiple times.

* * * * *